US011369166B2

(12) United States Patent
Berry, Jr.

(10) Patent No.: US 11,369,166 B2
(45) Date of Patent: Jun. 28, 2022

(54) LACE DOWN INSOLE SYSTEMS

(71) Applicant: Jonathan Lee Berry, Jr., Aurora, CO (US)

(72) Inventor: Jonathan Lee Berry, Jr., Aurora, CO (US)

( * ) Notice: Subject to any disclaimer, the term of this patent is extended or adjusted under 35 U.S.C. 154(b) by 328 days.

(21) Appl. No.: 16/448,887

(22) Filed: Jun. 21, 2019

(65) Prior Publication Data

US 2019/0320762 A1 Oct. 24, 2019

Related U.S. Application Data

(63) Continuation-in-part of application No. 15/840,094, filed on Dec. 13, 2017, now Pat. No. 10,376,013.

(60) Provisional application No. 62/703,881, filed on Jul. 27, 2018.

(51) Int. Cl.
*A43C 7/00* (2006.01)
*A43B 17/00* (2006.01)

(52) U.S. Cl.
CPC ..... *A43C 7/00* (2013.01); *A43B 17/006* (2013.01)

(58) Field of Classification Search
None
See application file for complete search history.

(56) References Cited

U.S. PATENT DOCUMENTS 4,439,935 A * 4/1984 Kelly ..... A43B 3/128 36/100
4,999,888 A * 3/1991 Miller ..... A43B 1/0081 24/306
5,671,517 A * 9/1997 Gourley ..... A43B 3/0078 24/306
6,895,696 B1 * 5/2005 Sanders ..... A43B 3/0031 24/712.1
7,779,519 B2 * 8/2010 Ashwood, Jr. ..... A43C 7/02 24/712.3
2013/0205618 A1 * 8/2013 Martigny ..... A43C 7/02 36/54

FOREIGN PATENT DOCUMENTS

EP 1510144 A2 * 3/2005 ..... A43B 17/18
FR 2539966 A1 * 8/1984 ..... B32B 5/245
WO WO-2015030841 A1 * 3/2015 ..... A43B 3/246

OTHER PUBLICATIONS

YouTube video titled "Simple How to Lace Shoes Normal Way and with No Bow" by stuntmotomoto, published Nov. 13, 2013 , and available at https://www.youtube.com/watch?v=Hxad0FDJJcM (Year: 2013).*

* cited by examiner

*Primary Examiner* — Daniel J Colilla

(57) ABSTRACT

The lace down insole system provides a removable shoe insole using hook and loop type fasteners as a method for retaining shoelaces beneath the insole. The lace down insole may comprise a top side and a bottom side with a plurality of "male" hook and loop type fasteners strategically placed on the bottom side of the insole, allowing the original shoelaces to be placed underneath the heel portion of the insole. This allows an efficient way for allowing shoes to have the ability to slide on and off without the need for tying the shoelaces.

2 Claims, 4 Drawing Sheets

LACE DOWN INSOLE SYSTEMS

BACKGROUND OF THE INVENTION

1. Field of the Invention

The present invention relates generally to the field of footwear and more specifically relates to shoe lacing systems.

2. Description of the Related Art

Shoelaces, sometimes called shoestrings or bootlaces, are a system commonly used to secure shoes, boots, and other footwear. They typically consist of a pair of strings or cords, one for each shoe, finished off at both ends with stiff sections, known as aglets. Each shoelace typically passed through a series of holes, eyelets, loops or hooks on either side of the shoe. Loosening the lacing allows the shoe to open wide enough for the foot to be inserted or removed. Tightening the lacing and tying off the ends secures the foot within the shoe, but sometimes makes the wearer feel uncomfortable.

Insoles are the interior bottom of a shoe, which sits directly beneath the foot under the footbed (also known as sock liner). The purpose of insole is to attach to the lasting margin of the upper, which is wrapped around the last during the closing of the shoe during the lasting operation.

There are many shoelace accessories. There are hooks to help lace shoelaces tightly. They are especially useful for skates where tight lacing is important. Shoelace covers protect the laces, especially in some sports like wrestling. Shoelace charms are decorative, as are colored shoelaces. Some laces are colored using expensive dyes, other, more "personal" colors, are drawn-on with permanent markers. Some dress codes (especially high schools) will specifically exclude color laces and charms. Lace-locks hold laces together, eliminating the need for tying.

There are also many insole designs. Some provide extra cushioning. Others are often added for comfort to control the shape. There are some designed for moisture or smell of the shoe. There are many designed for health reasons to help deal with differences in the natural shape of the foot or positioning of the foot during standing or walking.

Many lace-lock accessories may require frequent adjustments or extra equipment in order to keep the laces in place for an extended period of time. Other lace-look accessories make it inconvenient for the user to slip their feet into and out of a shoe without additional adjustments being made for comfort. A suitable solution is desired.

Various attempts have been made to solve problems found in footwear art. Among these are found in: U.S. Pat. No. 4,999,888 to Miller; U.S. Pat. No. 5,671,517 to Gourley; U.S. Pat. No. 6,895,696 to Sanders; U.S. Pat. No. 7,779,519 to Ashwood, Jr.; and Publication No. 2013/0205618 to Martigny. This prior art is representative of footwear.

None of the above inventions and patents, taken either singly or in combination, is seen to describe the invention as claimed. Thus, a need exists for a reliable lace down insole system, and to avoid the above-mentioned problems.

BRIEF SUMMARY OF THE INVENTION

The present invention advantageously fills the aforementioned deficiencies by footwear shoelace accessories. The present invention is superior to other systems in that it effectively provides a shoe insole designed to hide the shoelaces underneath the insole.

The lace down insole system provides for a removable shoe insole with hook and loop fasteners on the bottom side of the insole as a method for retaining shoelaces underneath the insole. This allows an efficient way for allowing shoes to have the ability to slide on and off without the need for tying the shoelaces. The lace down insole system may be lifted towards the heel allowing the original shoelaces to hide underneath the insole. Upon pushing the insole back inside the shoe, the shoelaces will therefore be made stationary beneath the insole by means of the added hook and loop fasteners or another stationary material, thereby hiding the shoelaces and converting an ordinary shoe from needing to be tied, into a comfortable and secure slip on shoe.

The lace down insole system may be available in sizes ranging from children to large adults. There may further be different models or versions that vary in materials and dimensions for purposes of accommodating different shoe types including, but not limited to, dress shoes, work boots, tennis shoes, and other active footwear. The lace down insole system may be constructed form materials that are soft and comfortable, but strong enough to prevent the user from feeling the shoelaces that are hidden beneath the insole.

The features of the invention which are believed to be novel are particularly pointed out in the specification. The present invention now will be described more fully hereinafter with reference to the accompanying drawings, which are intended to be read in conjunction with both this summary, the detailed description and any preferred and/or particular embodiments specifically discussed or otherwise disclosed. This invention may, however, be embodied in many different forms and should not be construed as limited to the embodiments set forth herein; rather, these embodiments are provided by way of illustration only and so that this disclosure will be thorough, complete and will fully convey the full scope of the invention to those skilled in the art.

BRIEF DESCRIPTION OF THE DRAWINGS

The figures which accompany the written portion of this specification illustrate embodiments and method(s) of use for the present invention, a lace down shoe insole system, constructed and operative according to the teachings of the present invention.

The various embodiments of the present invention will hereinafter be described in conjunction with the appended drawings, wherein like designations denote like elements.

DETAILED DESCRIPTION

The present invention is directed to a lace down insole system. In one embodiment of the present invention, lace down insole systems may comprise a top side and bottom side with a plurality of hook and loop fasteners configured for the secure organization and retention of shoe laces.

Figure 1:
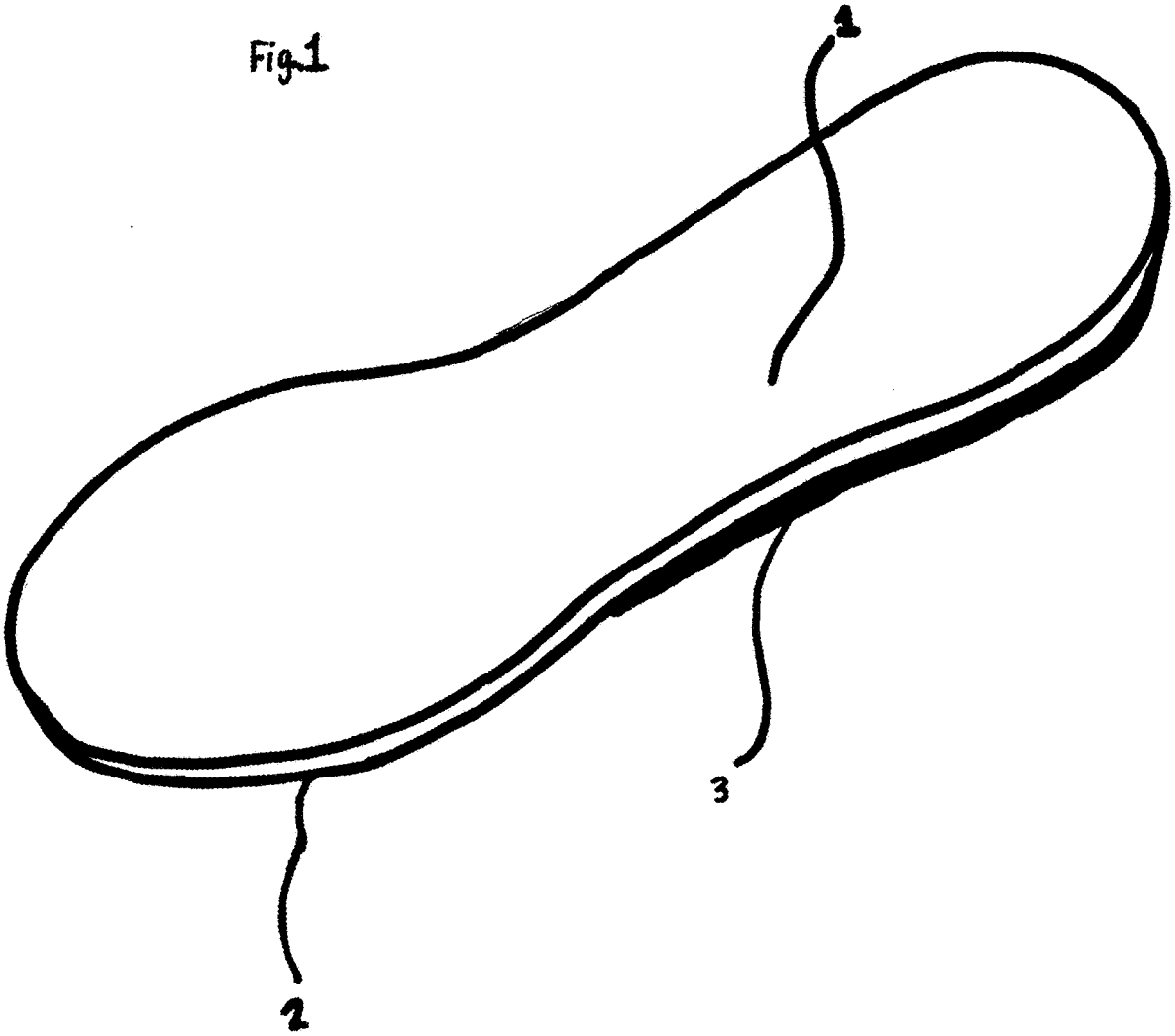
FIG. 1 is a top perspective view of a lace down shoe insole system showing the top side and a portion of the bottom side where the hook and loop fasteners are according to an embodiment of the present invention.

Referring now to the drawings, there is shown in FIG. 1 a lace down insole system including a top side (1) and bottom side (2). The back portion of the bottom side has a hook and loop slab (3). The hook and loop slab (3) may be constructed from hook and loop fasteners or another similar material fastener.

Figure 2:
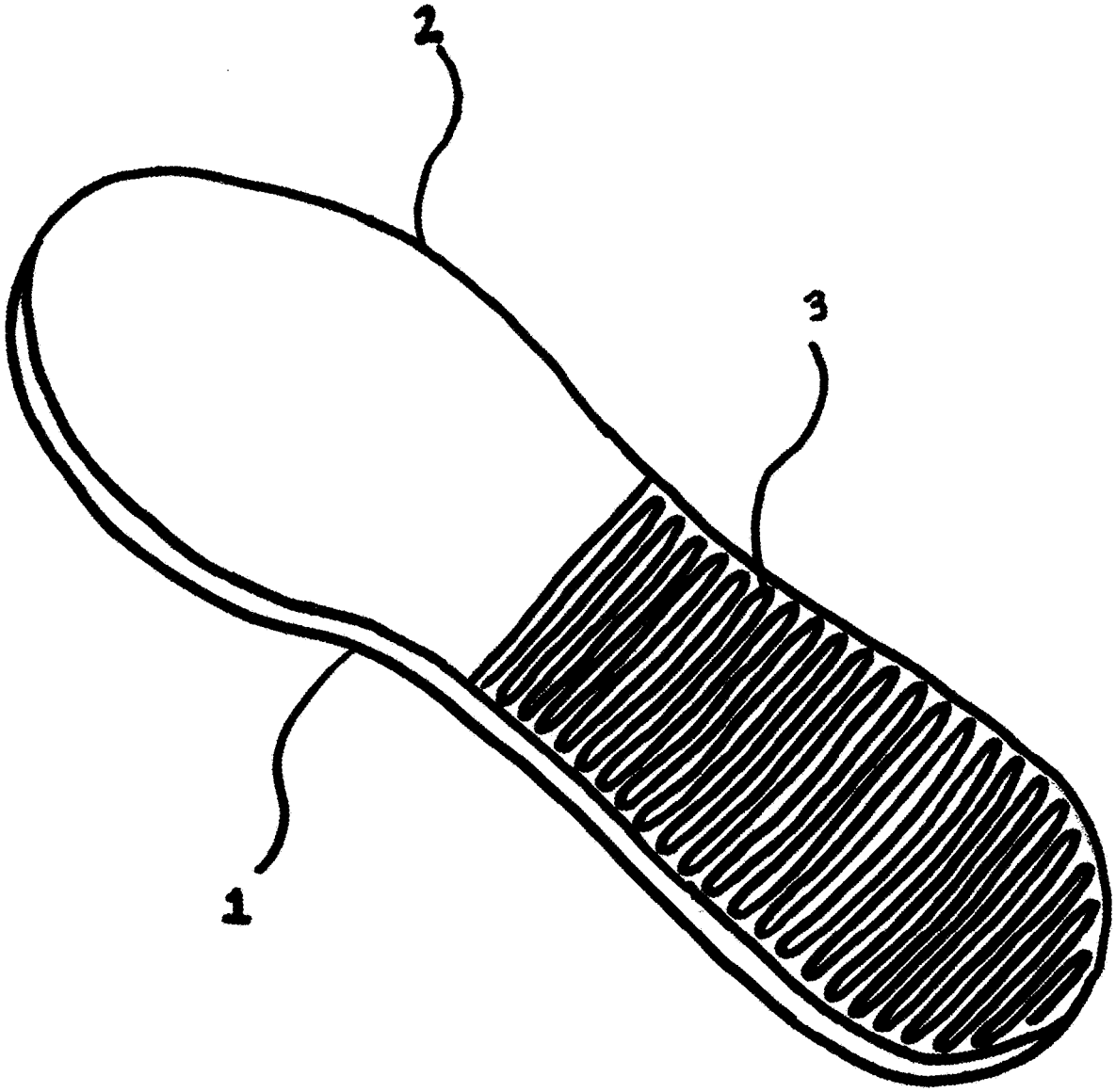
FIG. 2 is a bottom perspective view illustrating the lace down insole system comprising a bottom side with the hook and loop fasteners from the middle to the heel of the assembly and the top side of the insole according to an embodiment of the present invention.

Referring now to FIG. 2 showing a bottom perspective view of a lace down insole system including a top side (1) and a bottom side (2) with a hook and loop slab (3) from the middle the insole to the heel of the insole. The bottom side (2) shows the hook and loop slab (3), with the "U"-shaped hook and loop 'male' side. The hook and loop slab (3) is a large portion of hook and loop type material that rests from the middle of the insole to the heel of the insole. The hook and loop slab (3) holds the shoelaces in place after the shoelaces have been placed against them. Once the shoelaces have been placed against the hook and loop slab (3) and the lace down insole is put back inside the shoe, this allows an efficient way for allowing shoes to have the ability to slide on and off without the need for tying the shoelaces.

Figure 3:
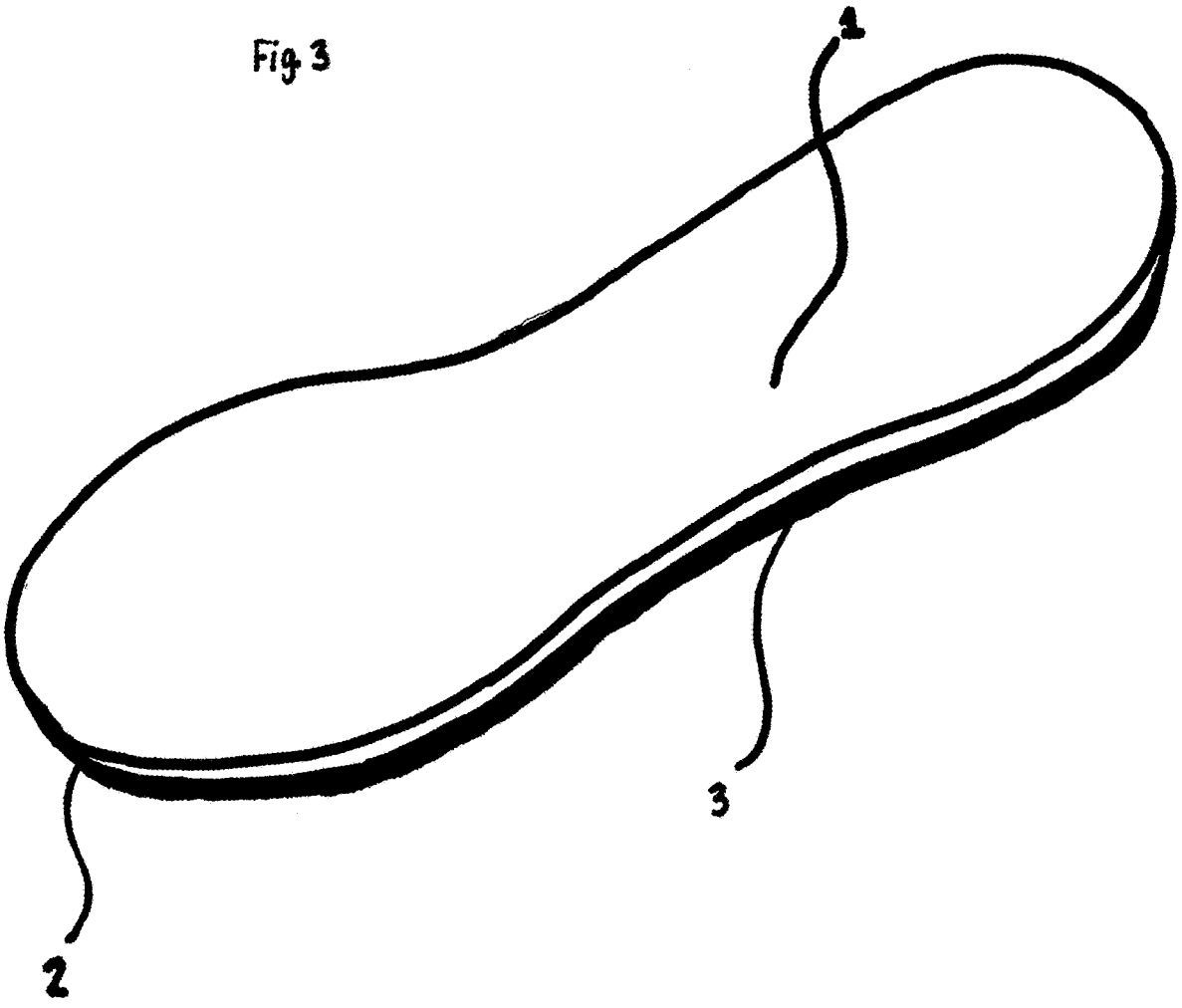
FIG. 3 is a top perspective view of a lace down shoe insole system showing the top side and a portion of the bottom side where the hook and loop fasteners are according to an embodiment of the present invention.

Referring now to the drawings, there is shown in FIG. 3 a lace down insole system including a top side (1) and bottom side (2). The entire bottom side has a hook and loop slab (3). The hook and loop slab (3) may be constructed from hook and loop fasteners or another similar material fastener.

Figure 4:
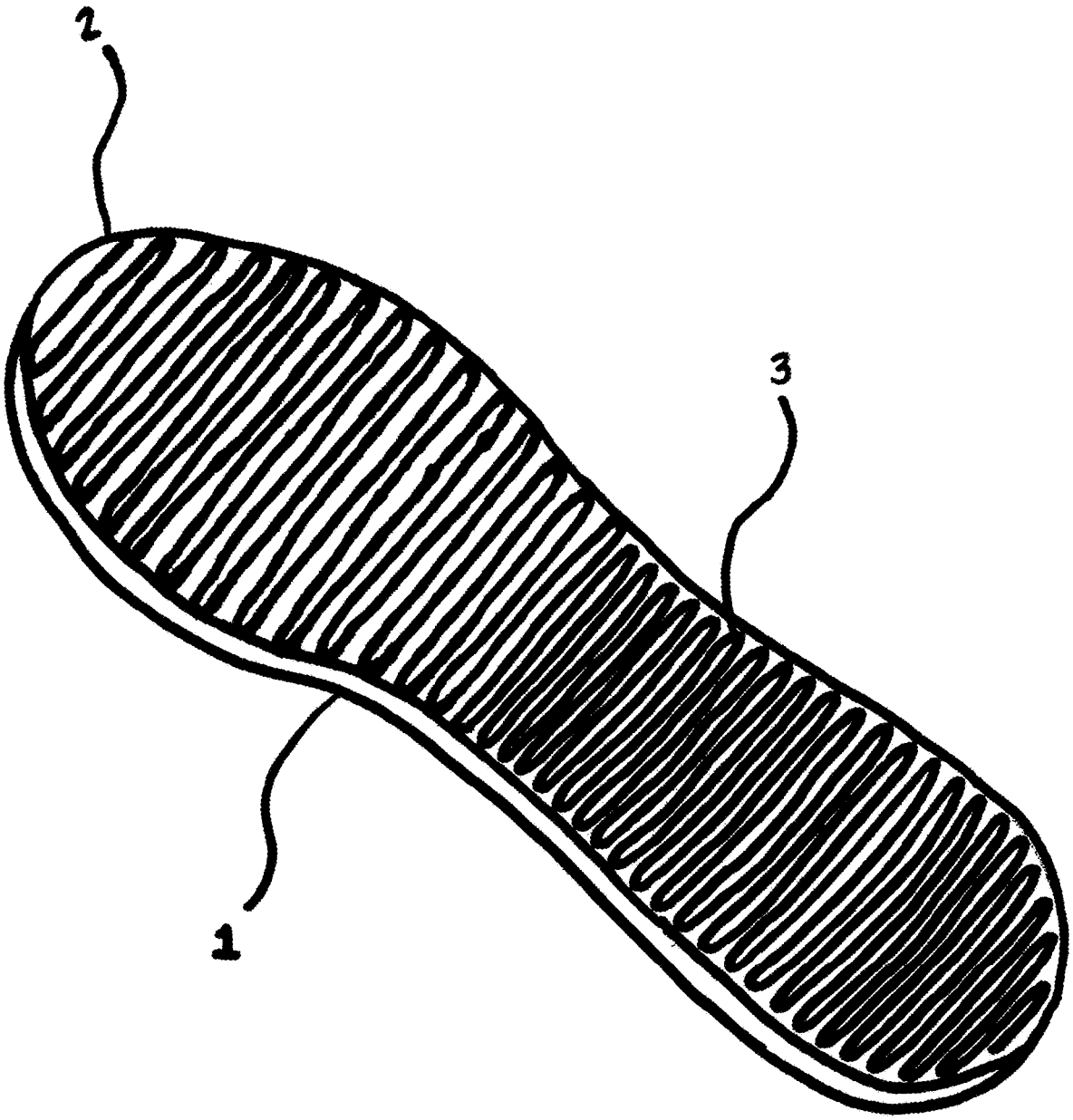
FIG. 4 is a bottom perspective view illustrating the lace down insole system comprising a bottom side with the hook and loop fasteners covering the entire bottom side of the assembly and the top side of the insole according to an embodiment of the present invention.

Referring now to FIG. 4 showing a bottom perspective view of a lace down insole system including a top side (1) and a bottom side (2) with a hook and loop slab (3) covering the entire bottom side (2) of the insole. The bottom side (2) shows the hook and loop slab (3), with the "U"-shaped hook and loop 'male' side. The hook and loop slab (3) is a large portion of hook and loop type material that covers the entire bottom side (2) of the insole. The hook and loop slab (3) holds the shoelaces in place after the shoelaces have been placed against them. Once the shoelaces have been placed against the hook and loop slab (3) and the lace down insole is put back inside the shoe, this allows an efficient way for allowing shoes to have the ability to slide on and off without the need for tying the shoelaces.

The exact specifications, materials used, and method of use of the lace down insole system may vary upon manufacturing.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The exemplary embodiment(s) were chosen and described in order to best explain the principles of the present invention and its practical application, to thereby enable others skilled in the art to best utilize the present invention and various embodiments with various modifications as are suited to the particular use contemplated.

The invention claimed is:

1. A lace down insole configured to hide shoelaces in a heel of a shoe comprising:

a front portion that is rounded to fit contours of the shoe;

a back portion that is rounded to fit a curved heel portion of the shoe;

a top side and a bottom side; and a fastener comprising a hook fastener portion of the hook and loop fastener type disposed on the back portion of the bottom side configured to secure shoelaces, wherein the fastener does not include a loop fastener portion, whereby the lace down insole is configured to secure the shoelaces against the hook fastener portion and configured to be inserted into the shoe.

2. The lace down insole according to claim 1, wherein an entire portion of the bottom side have said hook fastener portion to secure the shoelaces.

* * * * *